US008684651B2

(12) United States Patent
Wang

(10) Patent No.: US 8,684,651 B2
(45) Date of Patent: Apr. 1, 2014

(54) AUTONOMOUS MOBILE ROBOT

(76) Inventor: Chin-Hsiung Wang, Taipei (TW)

( * ) Notice: Subject to any disclaimer, the term of this patent is extended or adjusted under 35 U.S.C. 154(b) by 1043 days.

(21) Appl. No.: 12/636,428

(22) Filed: Dec. 11, 2009

(65) Prior Publication Data

US 2011/0142584 A1 Jun. 16, 2011

(51) Int. Cl.
*B65G 1/00* (2006.01)

(52) U.S. Cl.
USPC ..... 414/278; 414/279

(58) Field of Classification Search
USPC ..... 414/278, 279, 519, 520
See application file for complete search history.

(56) References Cited

U.S. PATENT DOCUMENTS

| | | | | | |
|---|---|---|---|---|---|
| 4,715,766 | A * | 12/1987 | Gebhardt | 414/392 |
| 5,551,350 | A * | 9/1996 | Yamada et al. | 104/293 |
| 5,893,437 | A * | 4/1999 | Odachi et al. | 191/10 |
| RE38,540 | E * | 6/2004 | Bateman | 273/406 |
| 7,686,560 | B2 * | 3/2010 | Laurin et al. | 414/278 |
| 2006/0182552 | A1 * | 8/2006 | Jiang et al. | 414/278 |
| 2009/0252577 | A1 * | 10/2009 | Tuffs et al. | 414/222.01 |

* cited by examiner

*Primary Examiner* — Jonathan Snelting
(74) *Attorney, Agent, or Firm* — Jackson IPG PLLC

(57) ABSTRACT

An autonomous mobile robot includes a housing mounted on a track and controllable to move along the track and to stop at each selected location, two side covers pivotally mounted on the left and right sides of the housing and movable by a respective driving motor to close/open the left or right side of the housing, and a mechanism controllable to move a material carrier horizontally leftwards or rightwards to the outside of the housing after opening of the left-sided or right-sided side cover.

2 Claims, 19 Drawing Sheets

PRIOR ART Fig. 1

AUTONOMOUS MOBILE ROBOT

BACKGROUND OF THE INVENTION

1. Field of the Invention

The present invention relates to an autonomous mobile robot and more particularly, to such an autonomous mobile robot, which has the left or right side cover openable for allowing a material carrier loaded therein to be moved horizontally to the outside.

2. Description of the Related Art

FIG. 1 illustrates an autonomous mobile robot for transporting materials. As illustrated, the autonomous mobile robot 91 is movable along a monorail overhead track 92. The autonomous mobile robot 91 comprises a friction transmission mechanism (not shown) driven by a motor (not shown) to move along the monorail overhead track 92. When moved to a predetermined location, a gripping jaw mechanism 911 of the autonomous mobile robot 91 is controlled to move downwards and to grip the expected object and then controlled to lift the gripped object, and then the autonomous mobile robot 91 is controlled to move along the monorail overhead track 92 to a next stop to release the gripped object. This design of autonomous mobile robot 91 is still not satisfactory in function because of the following drawbacks:

1. Because a gripping jaw mechanism 911 of the autonomous mobile robot 91 must be lowered and then lifted when transporting an object from one location to another, the autonomous mobile robot 91 is not suitable for use in a working place in a factory that has a limited vertical height.
2. The gripping jaw mechanism 911 has a complicated structure and is expensive to manufacture. Further, the installation of the gripping jaw mechanism 911 requires much labor and time.

SUMMARY OF THE INVENTION

The present invention has been accomplished under the circumstances in view. It is one object of the present invention to provide an autonomous mobile robot, which is suitable for use in a work place that has a limited vertical height. It is another object of the present invention to provide an autonomous mobile robot, which is suitable for automatic operation. It is still another object of the present invention to provide an autonomous mobile robot, which has a simple structure and is easy and inexpensive to manufacture and to install without using any lifting mechanism.

To achieve these and other objects of the present invention, an autonomous mobile robot comprises a housing, a front cover covered on a front side of the housing, a rear cover covered on a rear side of the housing, front and rear friction transmission mechanisms respectively mounted on the housing at a top side and protected by a respective side guard, each friction transmission mechanism comprising a plurality of friction wheels respectively kept in contact with a top surface of a bottom rail of the track, a robot driving motor mounted therein, a friction transmission mechanism driving wheel kept in contact with a bottom surface of the bottom rail of the track, a robot driving motor controllable to rotate the friction transmission mechanism driving wheel for causing the autonomous mobile robot to move along the track. The housing has two side covers respectively pivotally mounted on the left and right sides thereof and movable by a respective driving motor to close/open a left or right open space, and a mechanism controllable to move a material carrier horizontally leftwards or rightwards to the outside of the housing through the left or right open space after opening of the left-sided or right-sided side cover.

DETAILED DESCRIPTION OF THE INVENTION

Figure 1:
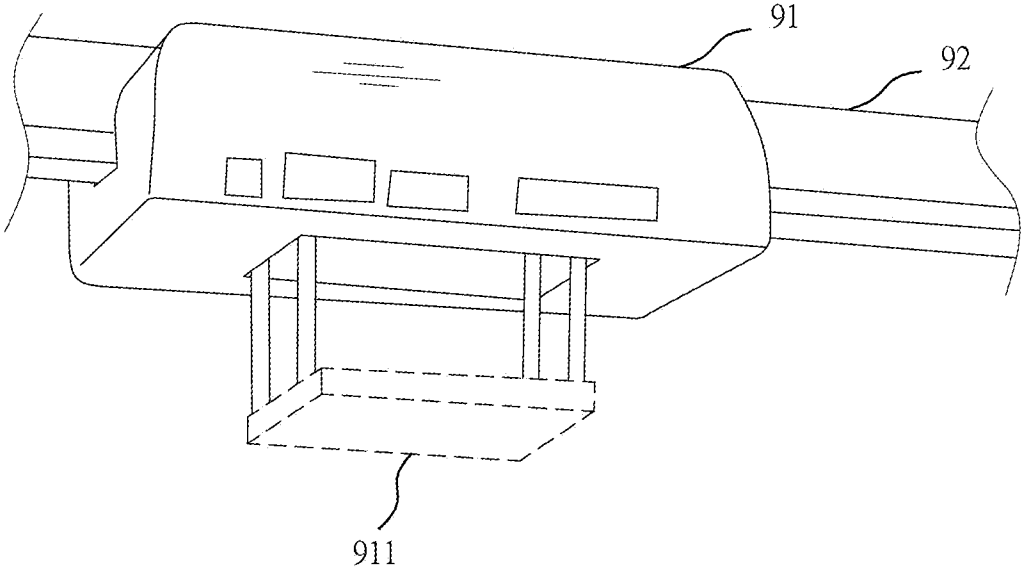
FIG. 1 is a perspective view showing an autonomous mobile robot mounted on a monorail overhead track according to the prior art.
Figure 2:
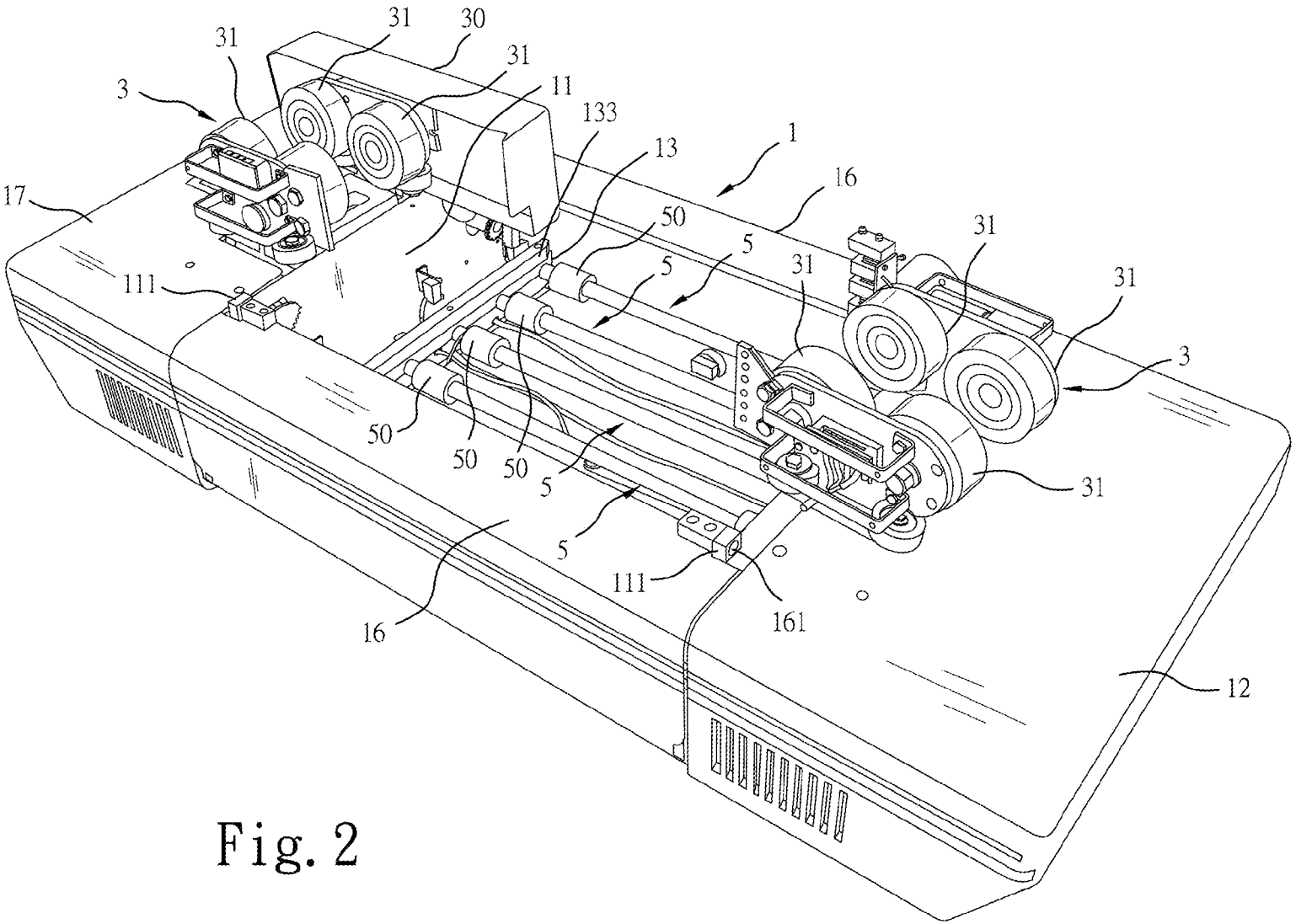
FIG. 2 is a perspective view of an autonomous mobile robot in accordance with a first embodiment of the present invention.

Referring to FIGS. 2~13 an autonomous mobile robot 1 is shown mounted on and movable along a track 2 (see FIG. 11) to transport materials. The autonomous mobile robot 1 can be controlled to move along the track 2 and to stop at every selected location. The track 2 supports and guides movement of the autonomous mobile robot 1.

The autonomous mobile robot 1 comprises a housing 11, a front cover 12 covered on the front side of the housing 11, a rear cover 17 covered on the rear side of the housing 11, front and rear friction transmission mechanisms 3 respectively mounted on the housing 11 at the top side and protected by a respective side guard 30, each friction transmission mechanism 3 having the friction wheels 31 thereof kept in contact with the top surface 211 of the bottom rail 21 of the track 2 (see FIG. 6), a robot driving motor 41 mounted in, for example, the front side inside the housing 11, a driving wheel 32 kept in contact with the bottom surface 212 of the bottom rail 21 of the track and rotatable by the robot driving motor 41. The robot driving motor 41 is a reversible motor controllable to rotate the driving wheel 32 clockwise or counter-clockwise, causing the autonomous mobile robot 1 to move along the track 2 forwards or backwards.

The main features of the present invention are described hereinafter.

The housing 11 has provided therein two upright supports 13 respectively disposed near the front and rear sides (see FIGS. 3 and 8), a plurality of conveying rods 5 pivotally connected between the two upright supports 13 in a parallel manner, a plurality of friction wheels 50 respectively fixedly mounted on the conveying rods 5, a plurality of transmission gears 51 respectively fixedly mounted on one end of each of the conveying rods 5, a plurality of driven gears 52 respectively pivotally mounted on one upright support 13 and respectively meshed with the transmission gears 51 (see FIGS. 8 and 10), and a driving gear 53 meshed with the two middle driven gears 52 and affixed to the motor shaft 421 of a carrier driving motor 42. When controlling the carrier driving motor 42 to rotate the driving gear 53 clockwise or counter-clockwise, the driven gears 52 are driven to rotate the transmission gears 51 and the conveying rods 5, and therefore the friction wheels 50 are rotated with the conveying rods 5 clockwise or counter-clockwise. Therefore, when a material carrier 14 is placed on the conveying rods 5 (see FIGS. 9 and 10), the friction wheels 50 can be rotated with the conveying rods 5 clockwise or counter-clockwise to move the material carrier 14 horizontally leftwards or rightwards. The housing 11 further comprises two open spaces 15 respectively defined in two opposite lateral sides (see FIGS. 9 and 12), four coupling blocks 111 disposed at the top side in the four corners and defining therein a respective coupling hole 1111, pivots 161 of two side covers 16 respectively coupled between the coupling holes 1111 of the coupling blocks 111, two side cover driving motors 43 respectively mounted therein, two pinions 432 respectively fixedly mounted on the output shaft 431 of each of the side cover driving motors 43, two sector gears 162 respectively fixedly mounted on the side covers 16 and respectively meshed with the pinions 432 at the output shafts 431 of the side cover driving motors 43 (see FIGS. 5 and 7). Therefore, when controlling the side cover driving motors 43 to rotate clockwise or counter-clockwise, the sector gears 162 are driven by the pinions 432 to bias the side covers 16 upwards or downwards, thereby opening or closing the open spaces 15.

Figure 9:
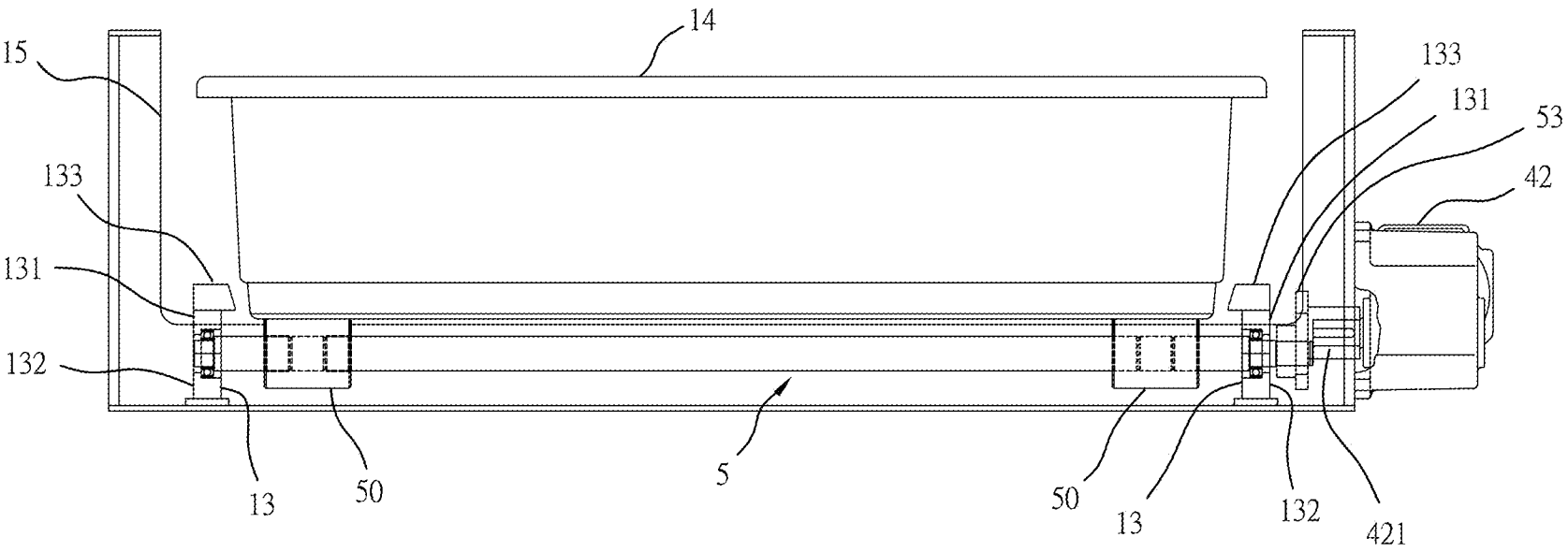
FIG. 9 is a schematic side view of a part of the autonomous mobile robot in accordance with the first embodiment of the present invention, showing a material carrier carried on the friction wheels at the conveying rods.
Figure 10:
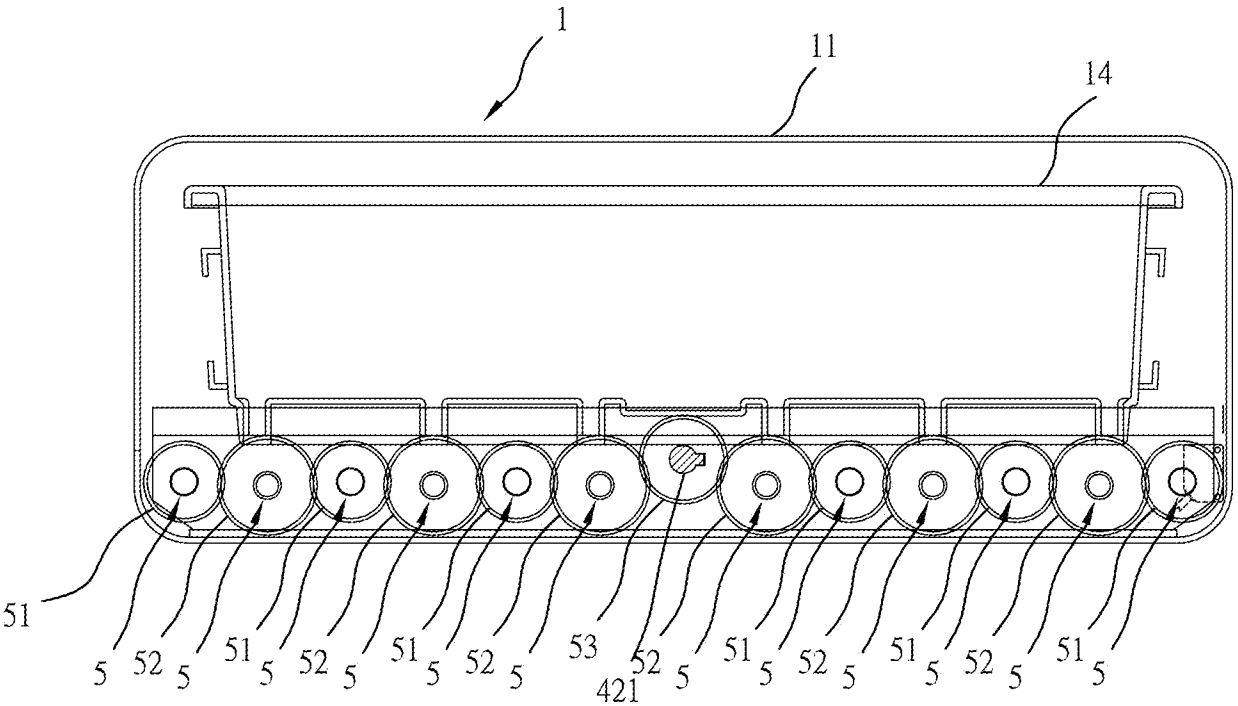
FIG. 10 is a schematic rear side view of the autonomous mobile robot in accordance with the first embodiment of the present invention.
Figure 11:
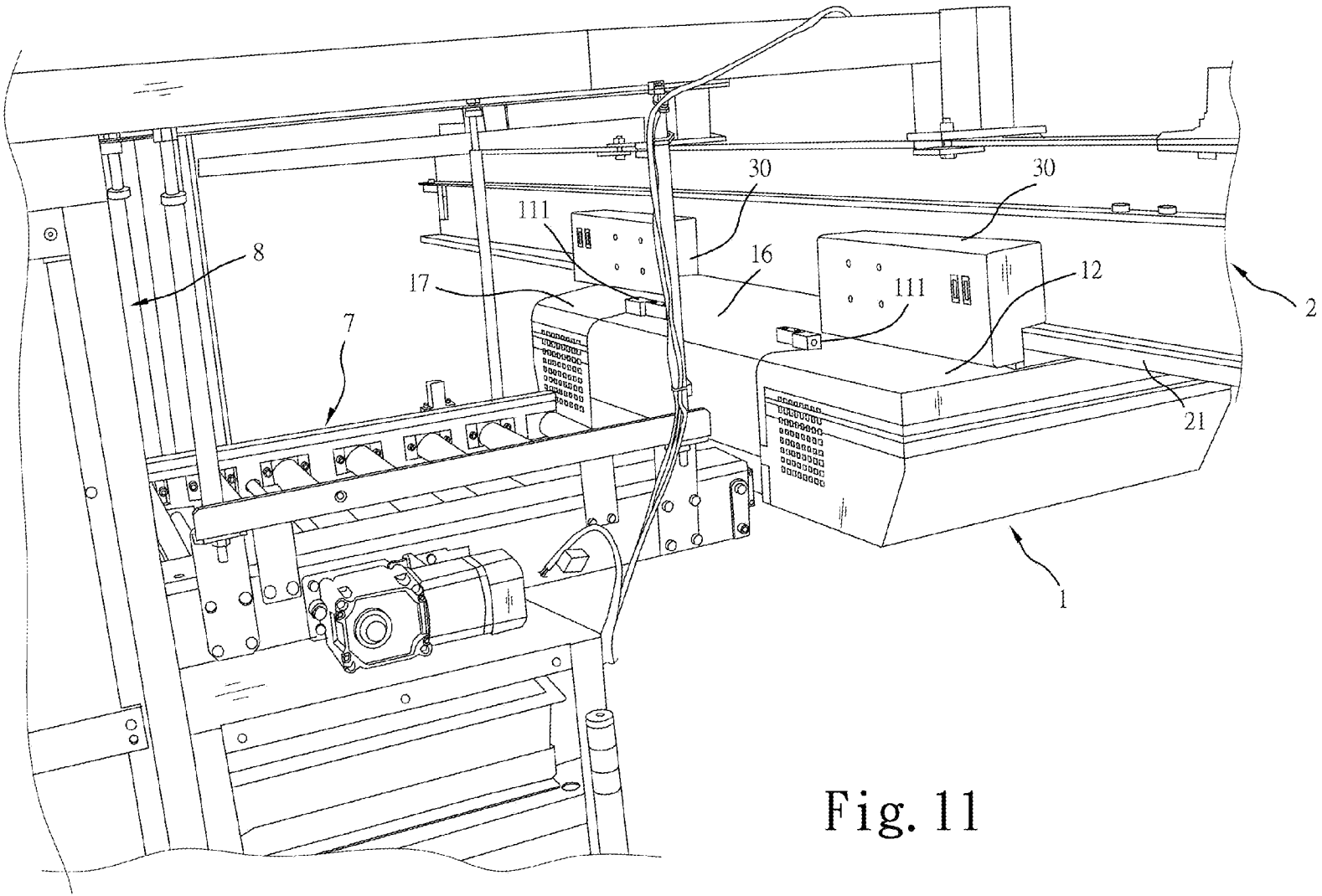
FIG. 11 is a schematic drawing of the first embodiment of the present invention, showing the autonomous mobile robot stopped at one end of a conveyer.
Figure 12:
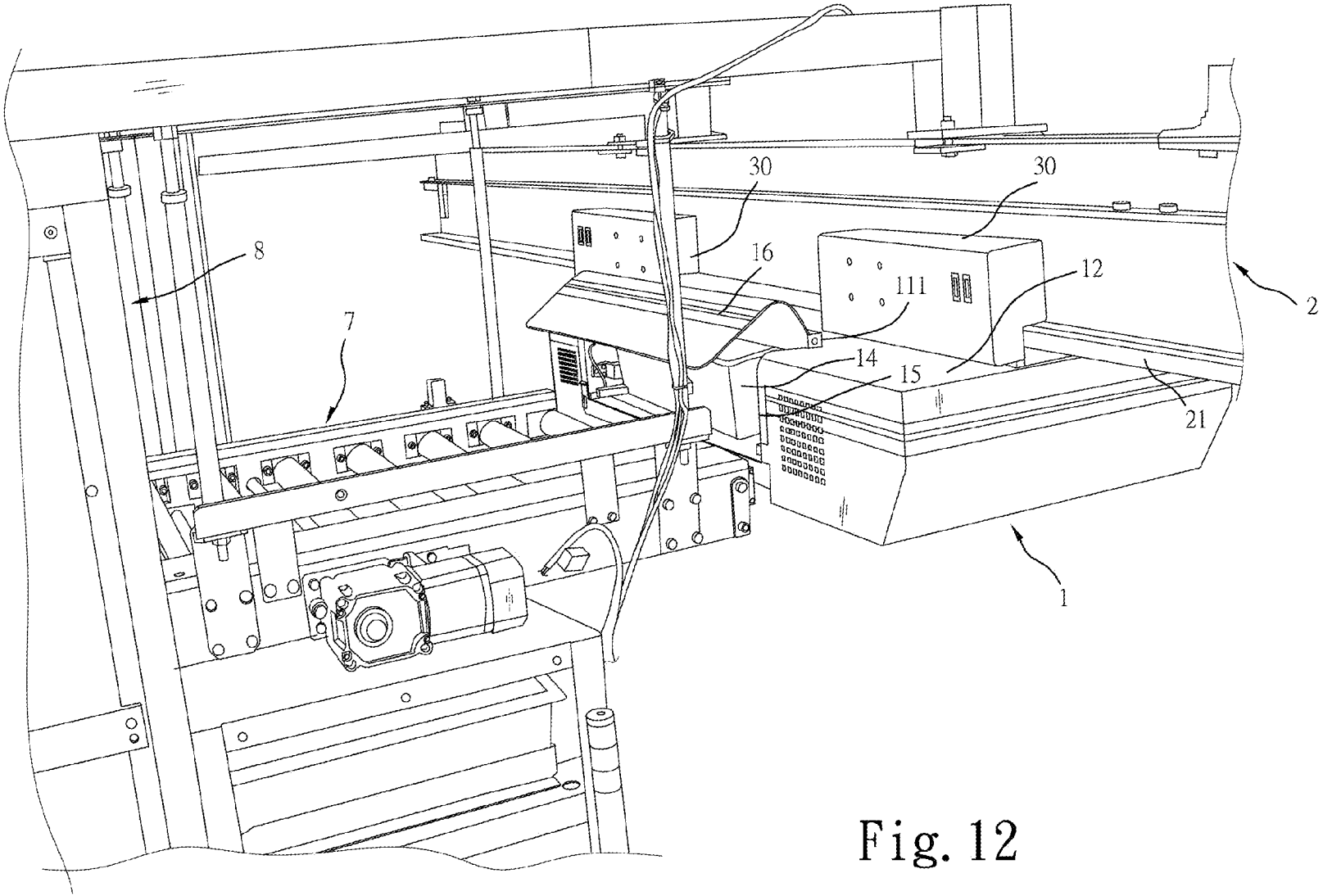
FIG. 12 corresponds to FIG. 11, showing the side cover of the housing of the autonomous mobile robot opened.
Figure 13:
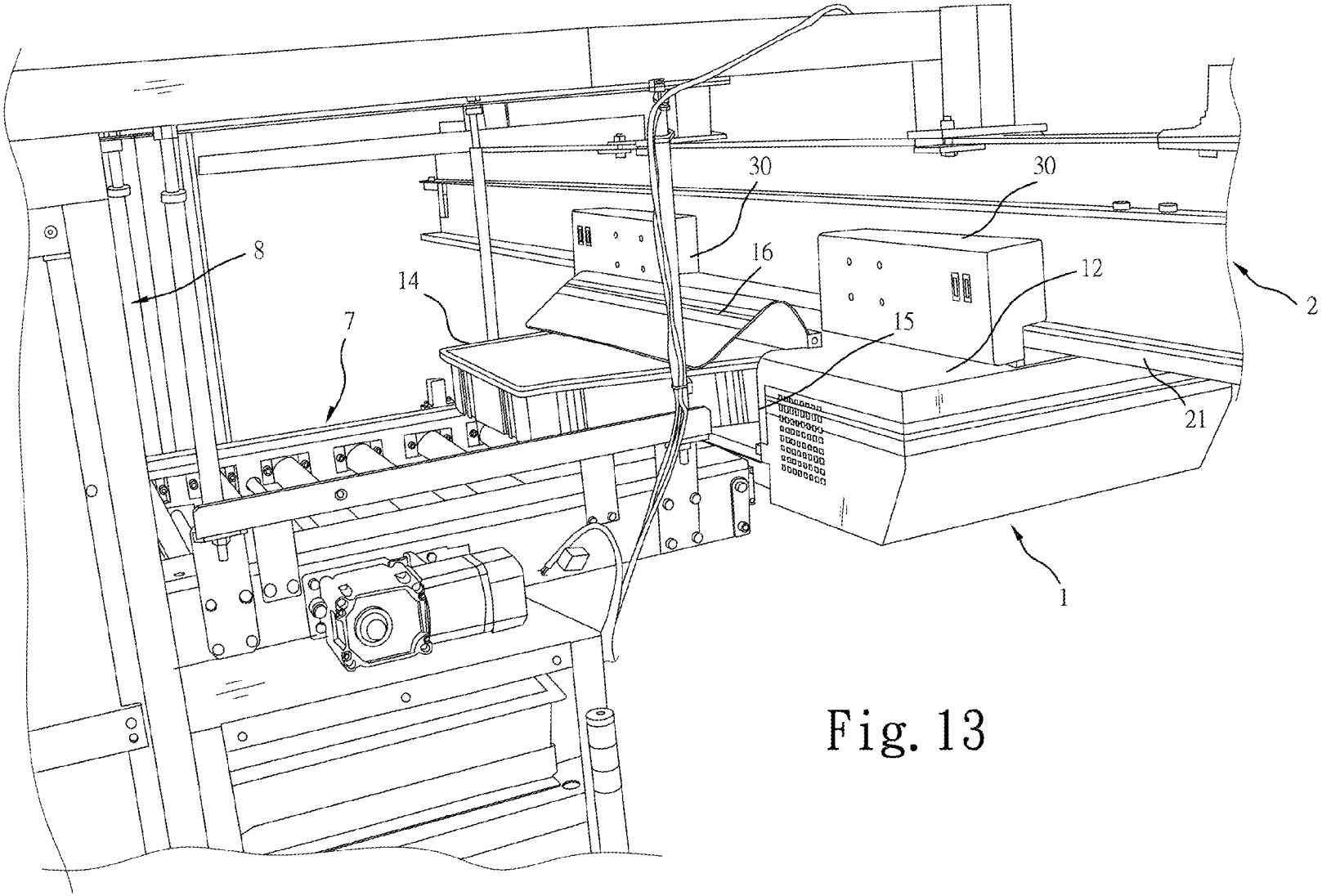
FIG. 13 corresponds to FIG. 12, showing the material carried moved out of the housing toward the conveyer.

During application of the present invention, a material carrier 14 that carries a stack or circuit boards or other materials (not shown) can be placed on the friction wheels 50 at the conveying rods 5 (see FIGS. 9 and 10). By means of controlling the carrier driving motor 42 to rotate the driving gear 53 clockwise or counter-clockwise, the driven gears 52 are driven to rotate the transmission gears 51 and the conveying rods 5, and therefore the friction wheels 50 are rotated with the conveying rods 5 clockwise or counter-clockwise to move the material carrier 14 horizontally leftwards or rightwards toward the open space 15 in the left or right side (see FIGS. 12 and 13). A feed table (not shown) or a conveyer 7 can be set to receive the material carrier 14 from the autonomous mobile robot 1 and to deliver the material carrier 14 to a lifter 8. Further, before moving the material carrier 14 to the open space 15 in the left or right side, the left-sided or right-sided side cover driving motor 43 must be controlled to rotate the associating pinion 432 and the meshed associating sector gear 162, biasing the associating side cover 16 upwards to open the open space 15 in the left or right side (see FIG. 12), so that the material carrier 14 can be delivered to the open space 15 in the left or right side and received by the conveyer 7. After the material carrier 14 has been delivered out of the housing 11 of the autonomous mobile robot 1, the left-sided or right-sided side cover driving motor 43 is controlled to reverse the associating pinion 432 and the meshed associating sector gear 162, biasing the associating side cover 16 downwards to close the open space 15 in the left or right side again, and then the robot driving motor 41 is controlled to move the autonomous mobile robot 1 along the track 2 to a nest stop for enabling another material carrier 14 that has a stack of circuit boards or other materials loaded therein be delivered into the inside of the housing 11 and supported on the friction wheels 50 at the conveying rods 5 after opening of the respective side cover 16 of the housing 11. After loading of the new material carrier 14, the side cover 16 is closed again.

Further, the aforesaid track 2 can be a straight line or endless line. One or a number of autonomous mobile robots 1 can be mounted on the track 2 and respectively controlled to move along the track 2 subject to a predetermined control. Further, the autonomous mobile robots 1 can be selectively controlled to open the left-sided or right-sided side cover 16 and to move the respectively loaded material carrier 14 horizontally leftwards or rightwards.

Figure 3:
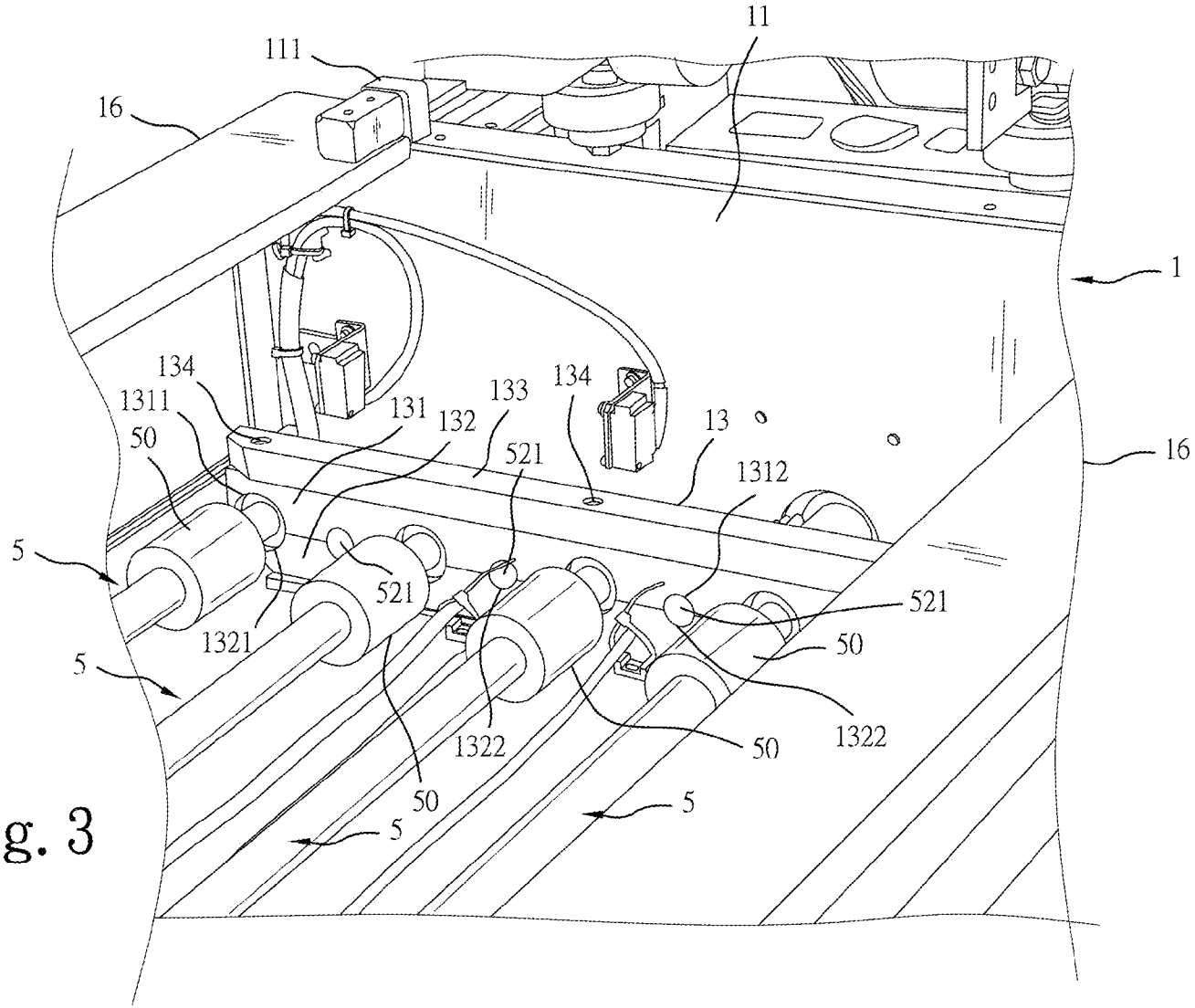
FIG. 3 is an enlarged view of a part of the autonomous mobile robot in accordance with the first embodiment of the present invention.
Figure 4:
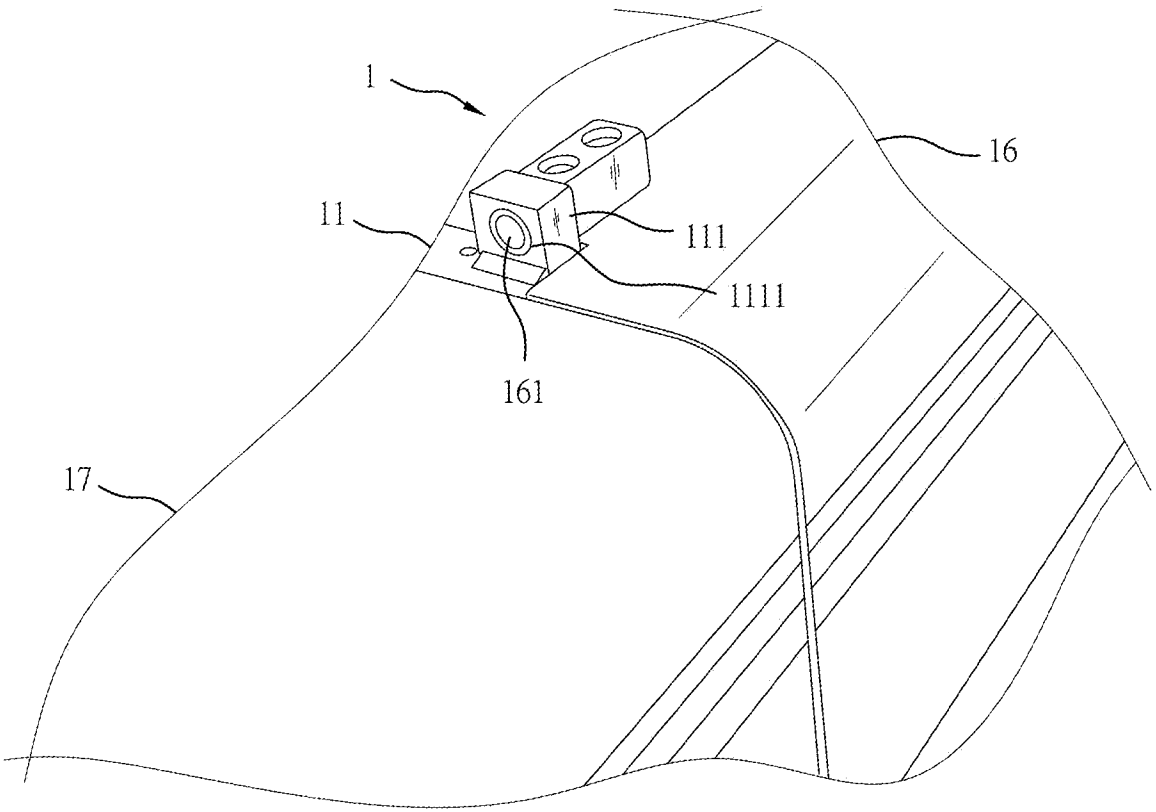
FIG. 4 is another partial view in an enlarged scale of the autonomous mobile robot in accordance with the first embodiment of the present invention.
Figure 5:
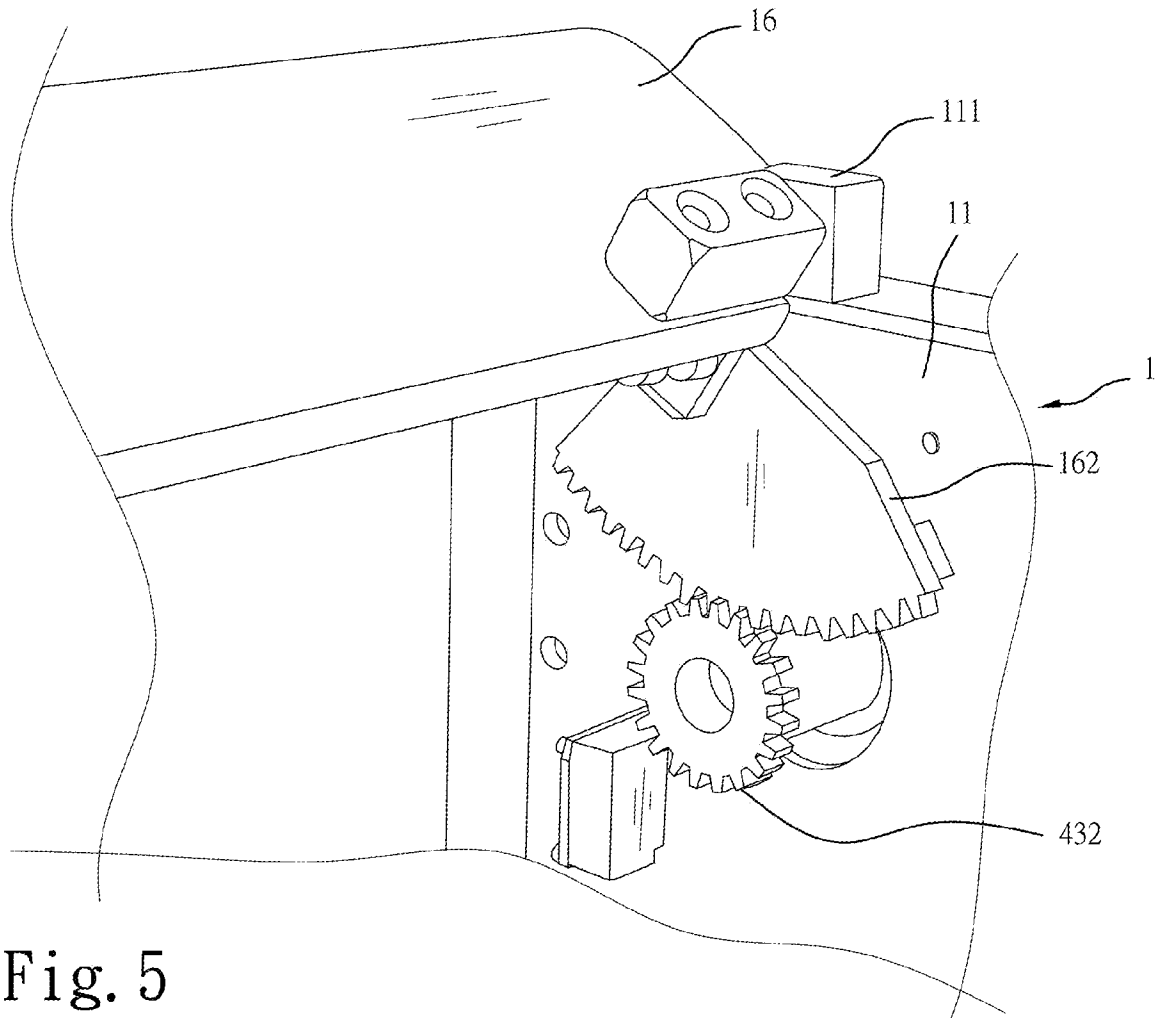
FIG. 5 is still another partial view in an enlarged scale of the autonomous mobile robot in accordance with the first embodiment of the present invention, showing one side cover lifted.
Figure 6:
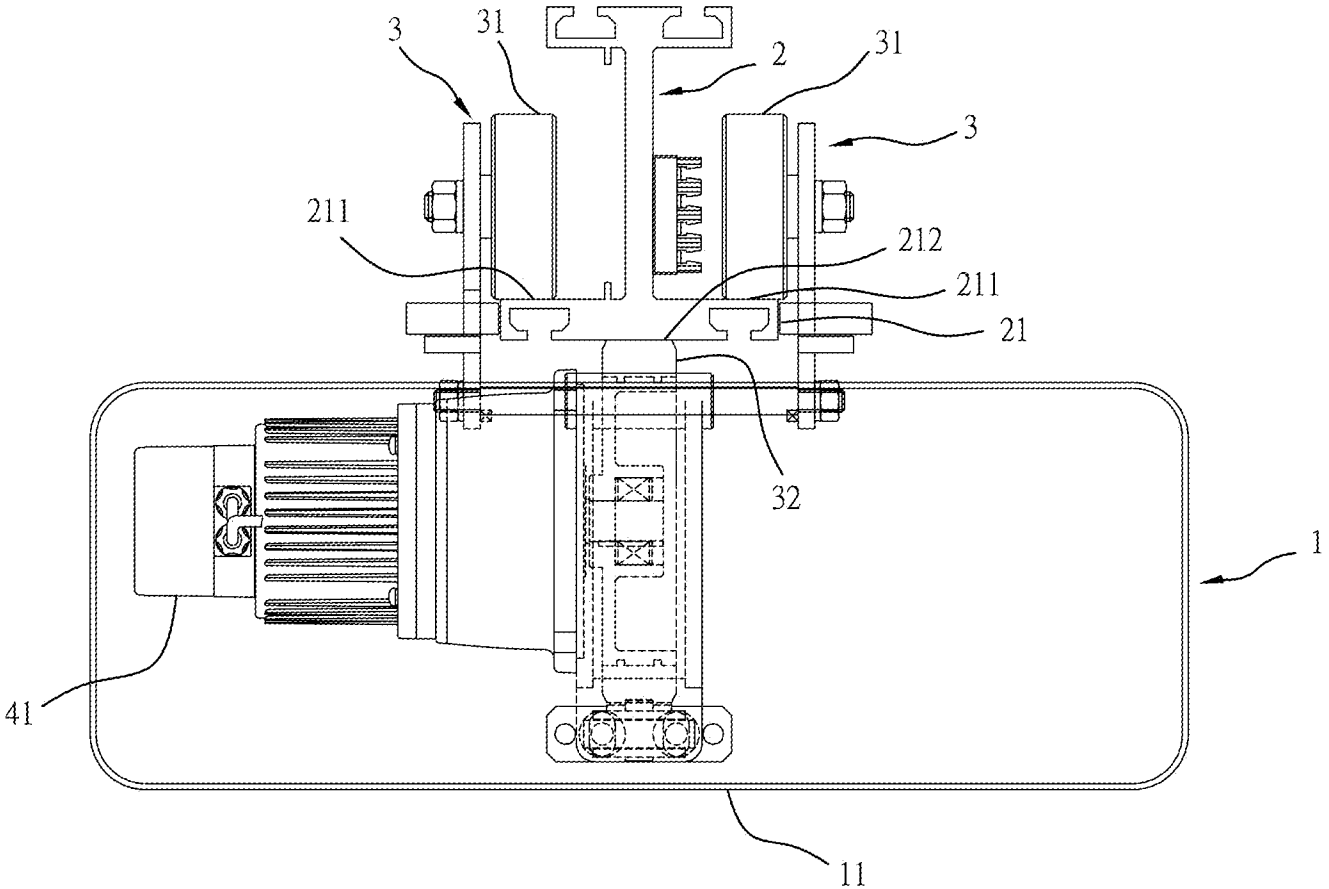
FIG. 6 is a front plain view in an enlarged scale of the autonomous mobile robot in accordance with the first embodiment of the present invention.
Figure 7:
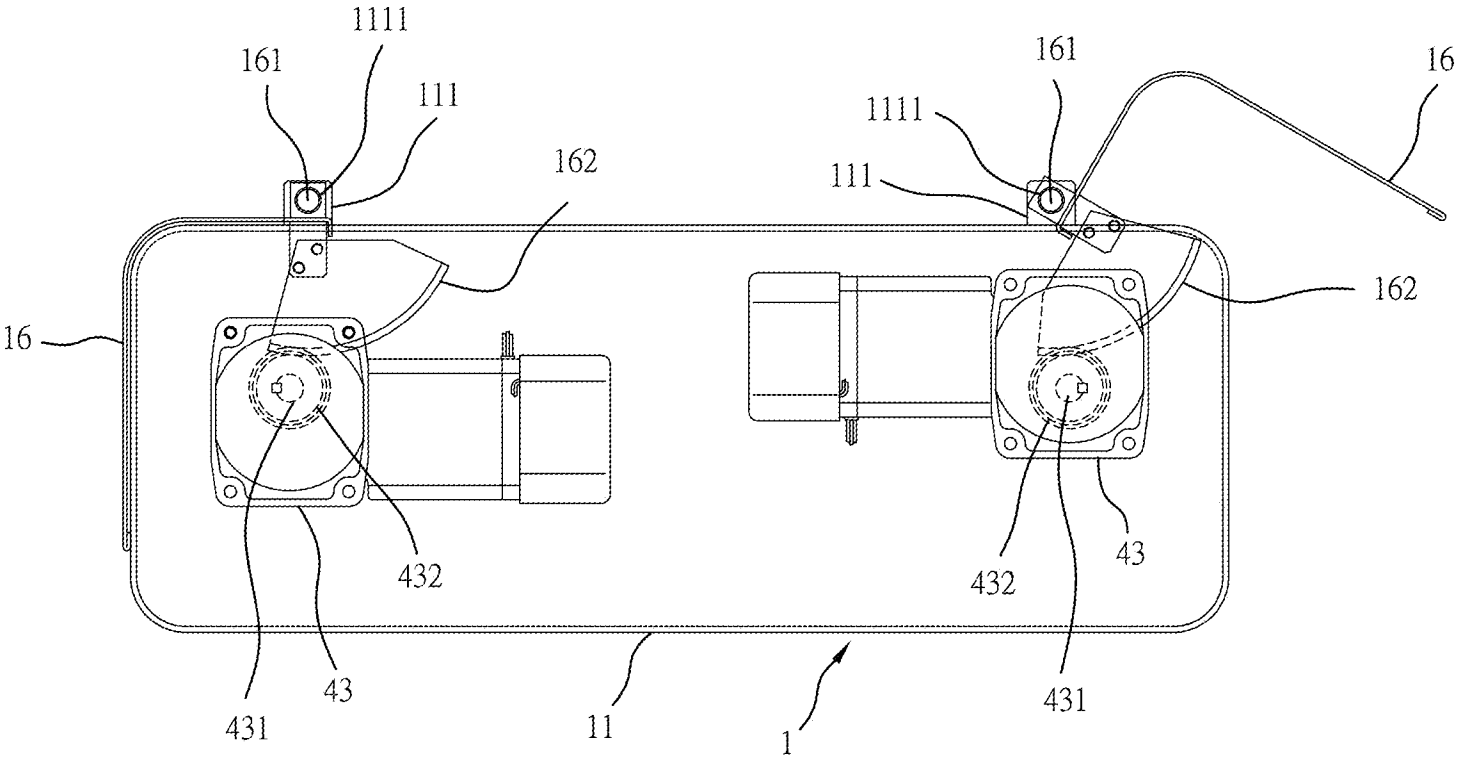
FIG. 7 is a sectional end view of the first embodiment of the present invention, showing one side cover opened.
Figure 8:
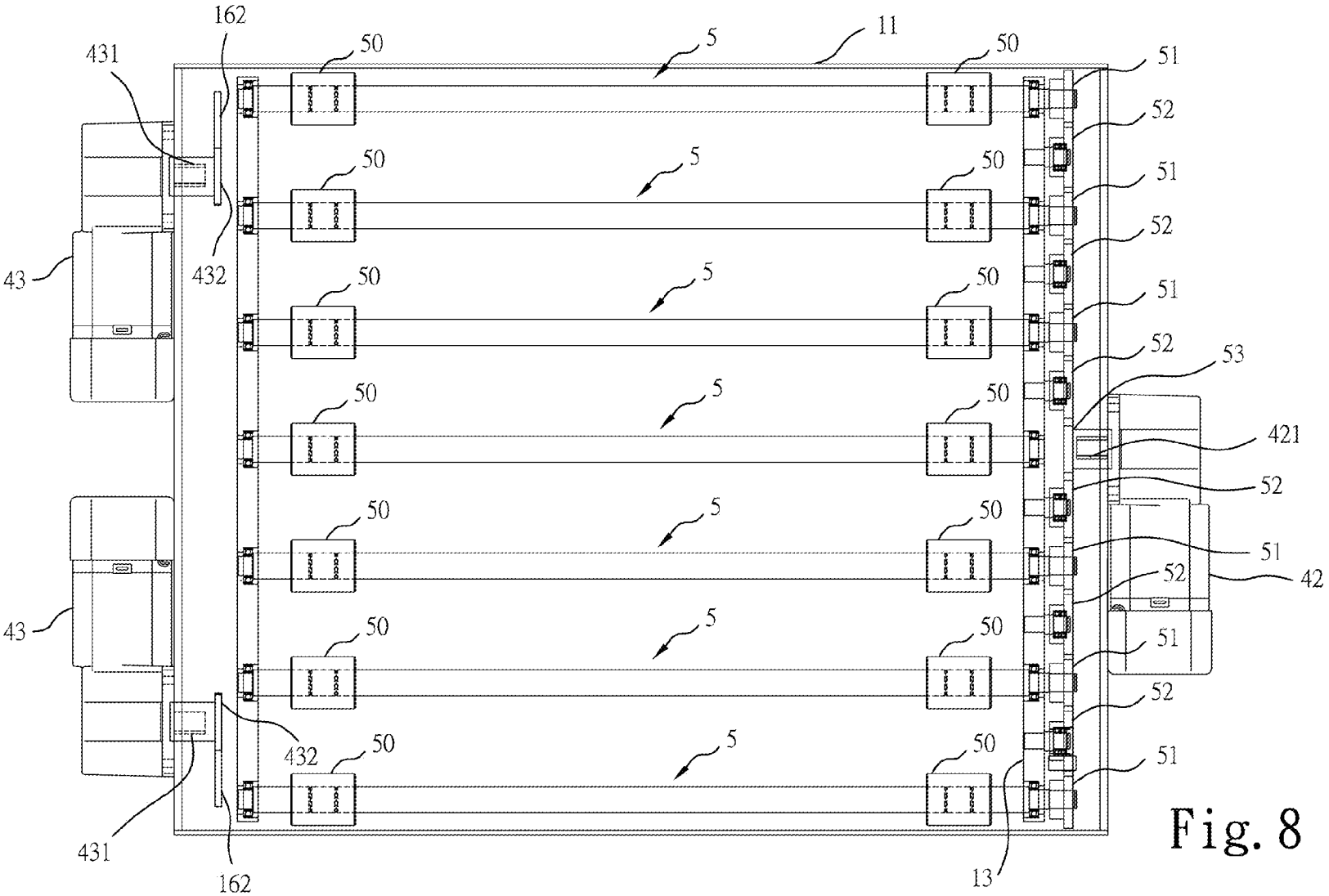
FIG. 8 is a schematic top plain view of the autonomous mobile robot in accordance with the first embodiment of the present invention.

Referring to FIG. 3, each upright support 13 of the housing 11 comprises a bottom block 132, an upper block 131 arranged on the top side of the bottom plate 132, a top bar 133 arranged on the top side of the upper block 131, and a plurality of fastening members 134 fastened to the top bar 133, the upper block 131 and the bottom block 132 to affix them together. The bottom block 132 is affixed to the bottom wall of the housing 11 with fastening members (not shown). Further, the bottom block 132 has a plurality of arched top notches 1321 and 1322; the upper block 131 has a plurality of arched bottom notches 1311 and 1312 respectively matching the arched top notches 1321 and 1322 of bottom block 132 for the mounting of the conveying rods 5 and the gear shafts 521 of the driven gears 52.

Further, the robot driving motor 41, the carrier driving motor 42 and the side cover driving motors 43 are controlled to start or to stop by a controller. A controller for this purpose can be achieved by conventional techniques. However, because the controller is not within the scope of the present invention, not further detailed description in this regard is necessary.

Figure 14:
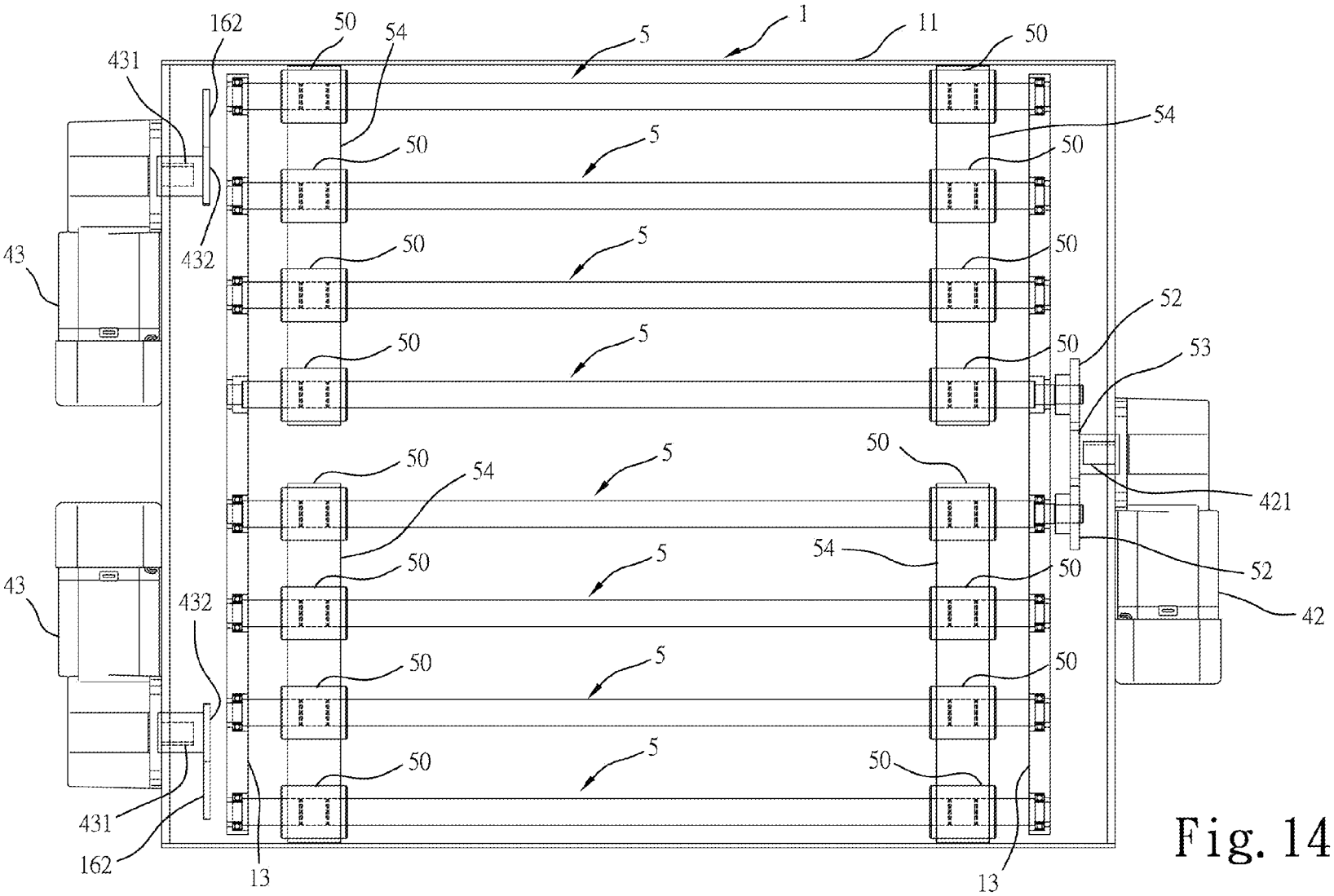
FIG. 14 is a schematic top plain view of and an autonomous mobile robot in accordance with a second embodiment of the present invention.
Figure 15:
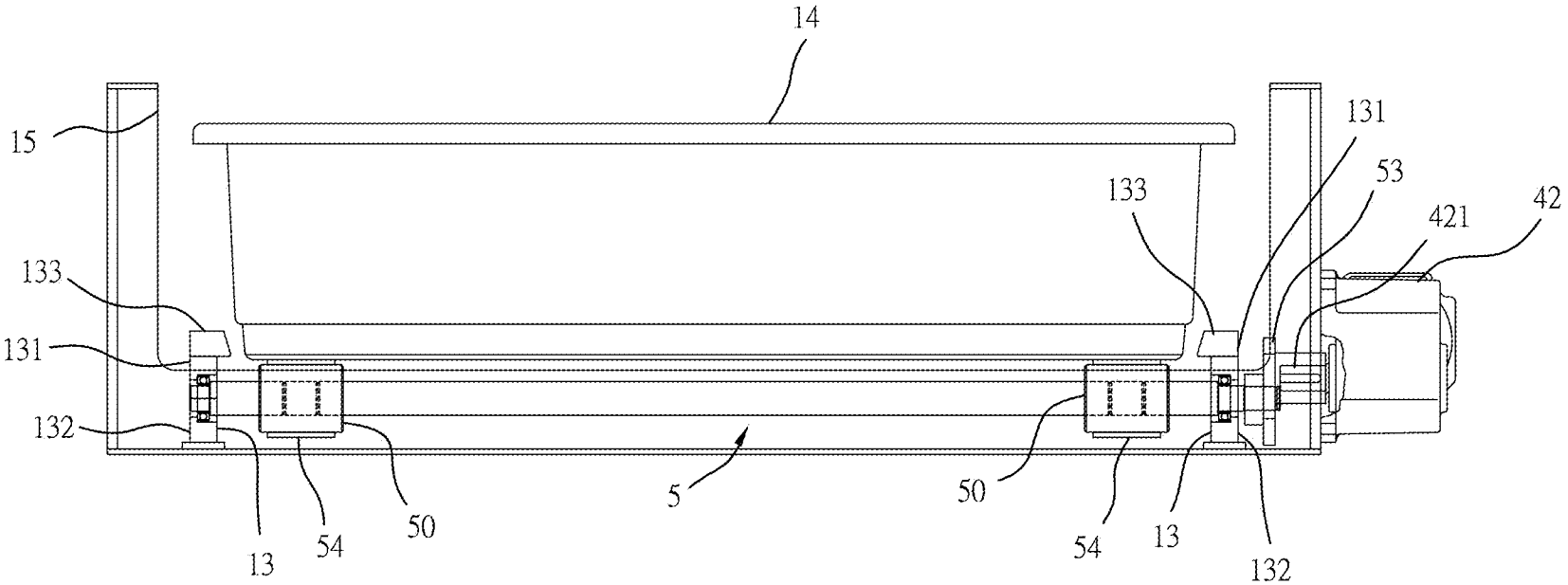
FIG. 15 is a schematic side plain view of a part of the autonomous mobile robot in accordance with the second embodiment of the present invention, showing the internal arrangement of the housing.
Figure 16:
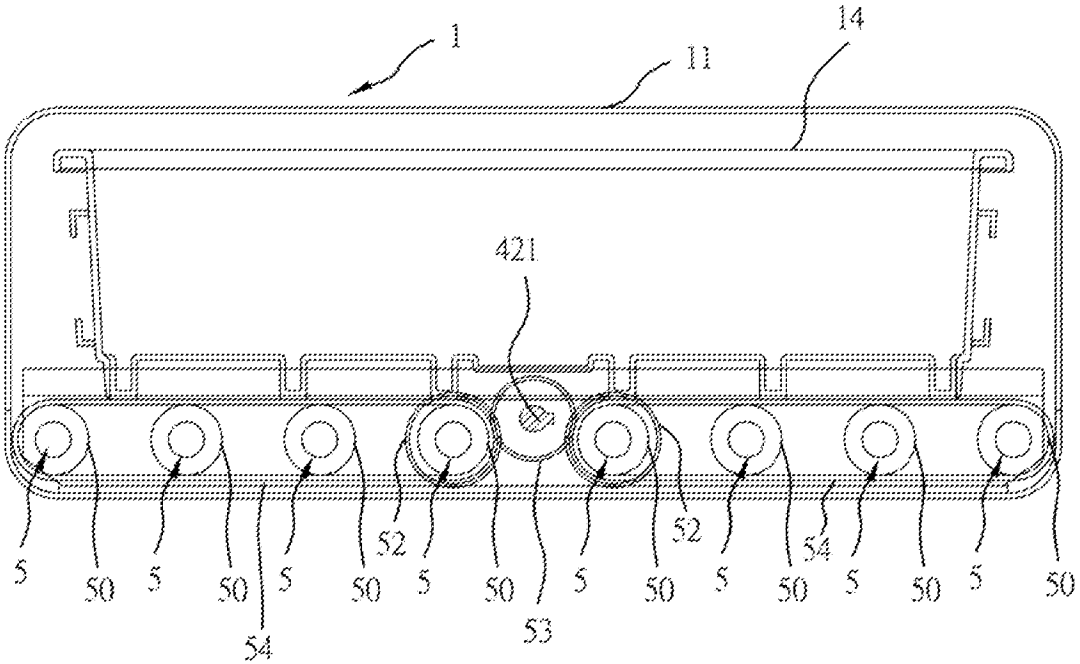
FIG. 16 is a schematic sectional end view of FIG. 15.

FIGS. 14~16 show an autonomous mobile robot in accordance with a second embodiment. This second embodiment is substantially similar to the aforesaid first embodiment with the exception of the transmission mechanism for moving a material carrier 14.

As illustrated in FIGS. 14~16, the housing 11 has provided therein two upright supports 13 respectively disposed near the front and rear sides (see FIG. 14), a plurality of conveying rods 5 pivotally connected between the two upright supports 13 in a parallel manner, a plurality of friction wheels 50 respectively fixedly mounted on the conveying rods 5, a plurality of endless belts 54 mounted on the friction wheels 50, two driven gears 52 respectively pivotally mounted on one end of each of two middle conveying rods 5, and a driving gear 53 meshed with the two driven gears 52 and affixed to the motor shaft 421 of a carrier driving motor 42 (see FIG. 15). By means of controlling the carrier driving motor 42 to rotate the driving gear 53 clockwise or counter-clockwise, the driven gears 52 are driven to rotate the conveying rods 5, and therefore the friction wheels 50 are rotated with the conveying rods 5 clockwise or counter-clockwise to move the material carrier 14 horizontally leftwards or rightwards toward the open space 15 in the left or right side (see FIGS. 15 and 16).

Figure 17:
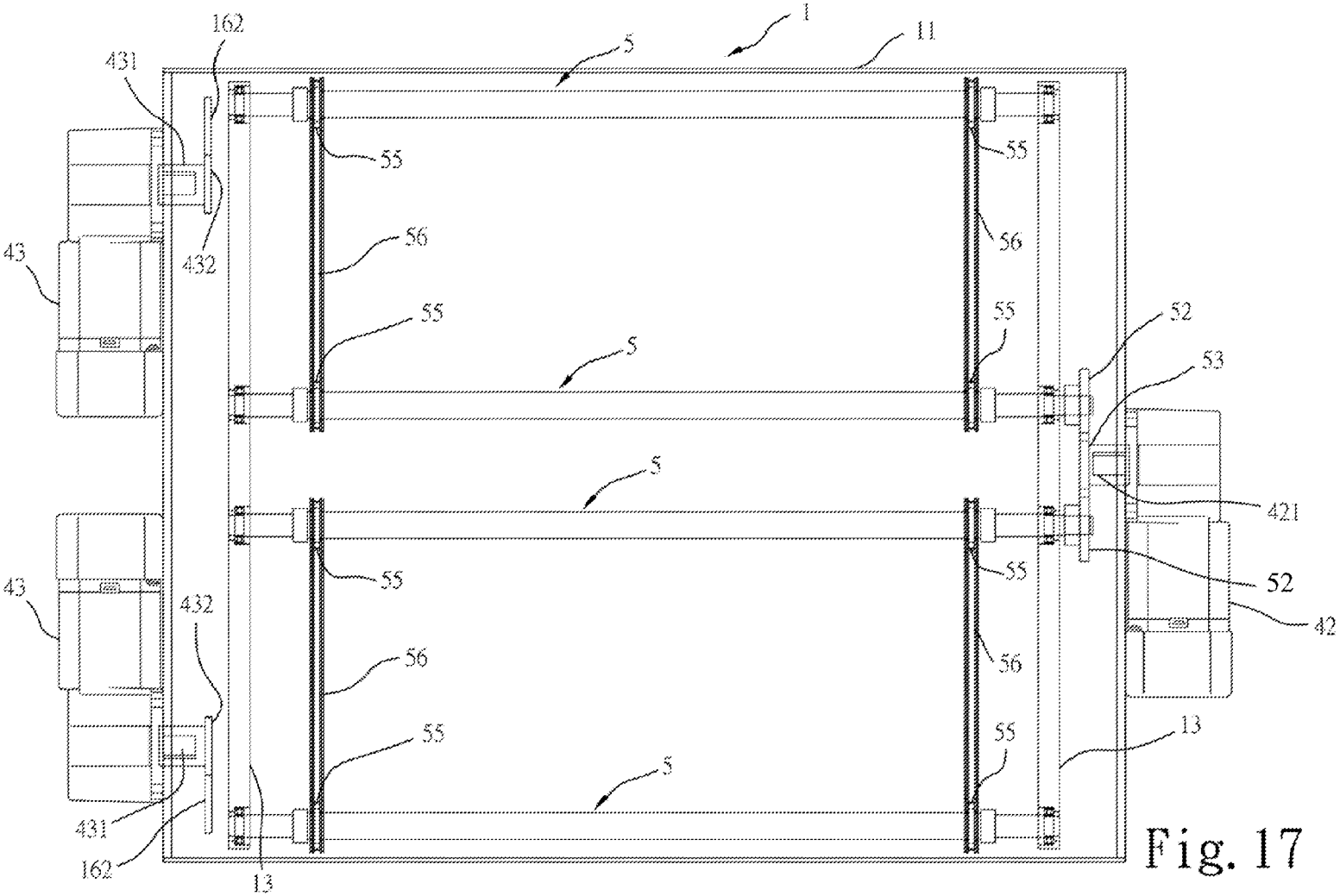
FIG. 17 is a schematic top plain view of and an autonomous mobile robot in accordance with a third embodiment of the present invention.
Figure 18:
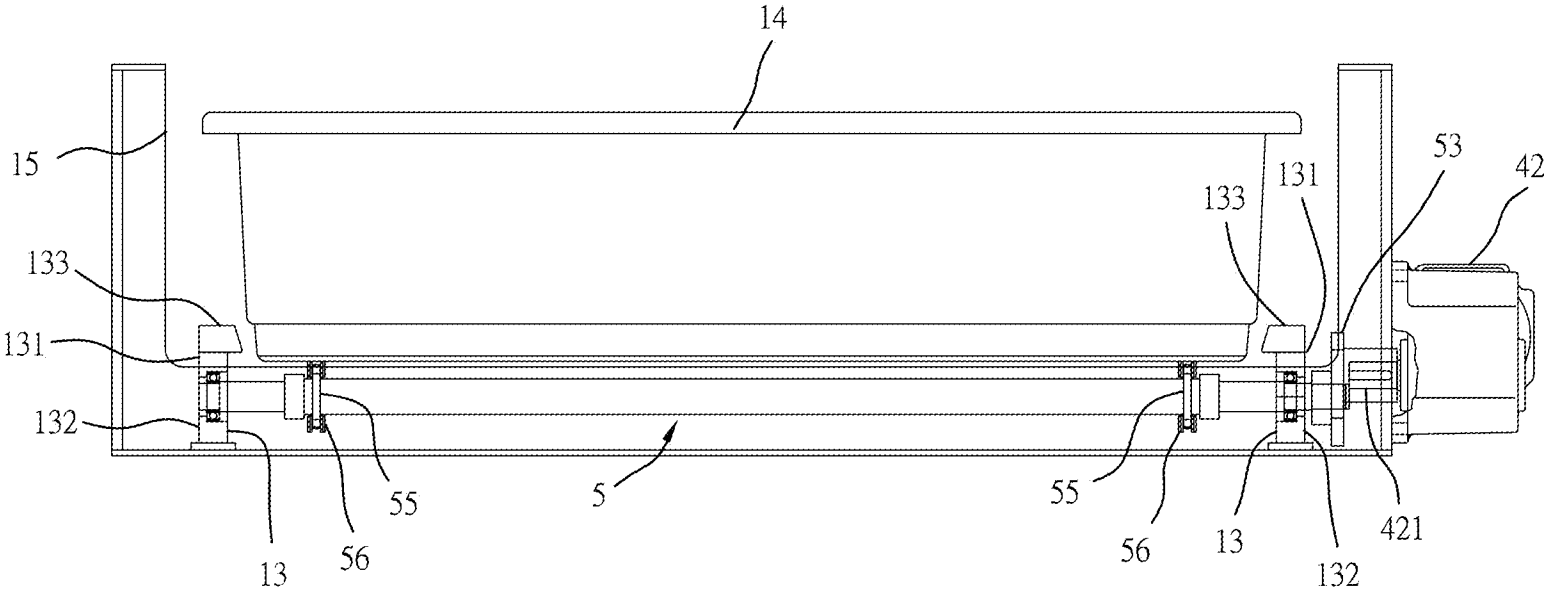
FIG. 18 is a schematic side plain view of a part of the autonomous mobile robot in accordance with the third embodiment of the present invention, showing the internal arrangement of the housing.
Figure 19:
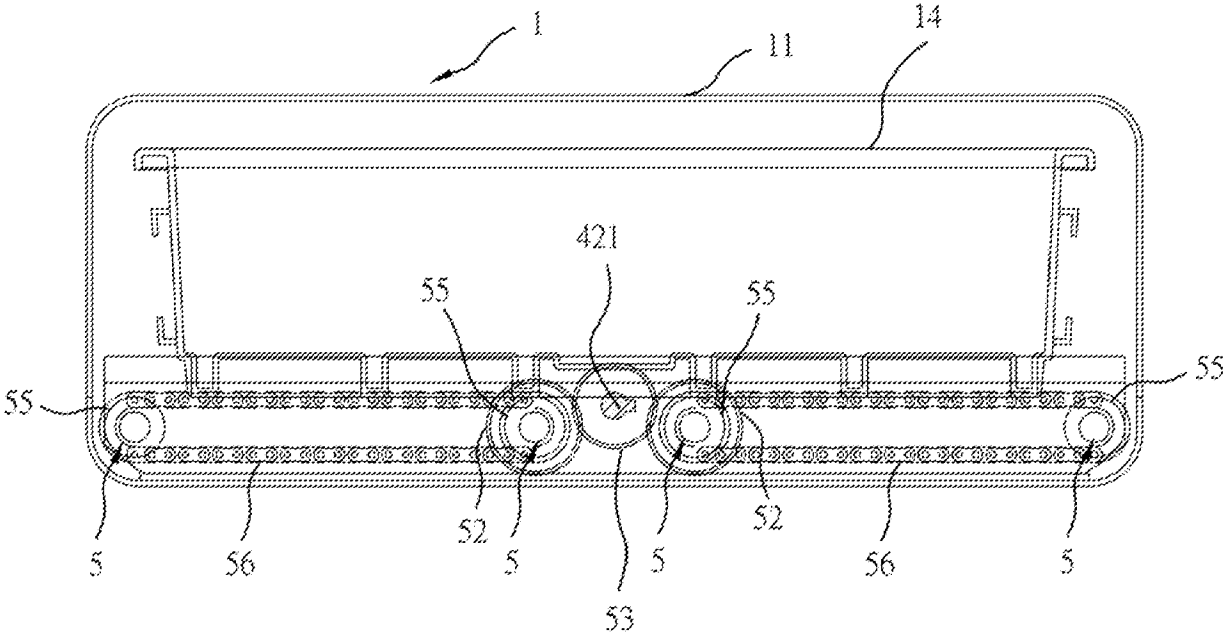
FIG. 19 is a schematic sectional end view of FIG. 18.

FIGS. 17~19 show an autonomous mobile robot in accordance with a third embodiment. This third embodiment is substantially similar to the aforesaid first embodiment with the exception of the transmission mechanism for moving a material carrier 14.

As illustrated in FIGS. 17~19, the housing 11 has provided therein two upright supports 13 respectively disposed near the front and rear sides (see FIG. 17), a plurality of conveying rods 5 pivotally connected between the two upright supports 13 and arranged in two parallel sets at the left and right sides, a plurality of sprockets 55 respectively fixedly mounted on the conveying rods 5, a plurality of chains 56 respectively mounted on the sprockets 55 at the left-sided and right-sided conveying rods 5, two driven gears 52 respectively mounted on one end of each of the left-sided and right-sided conveying rods 5 (see FIGS. 17 and 19), and a driving gear 53 meshed with the two driven gears 52 and affixed to the motor shaft 421 of a carrier driving motor 42. By means of controlling the carrier driving motor 42 to rotate the driving gear 53 clockwise or counter-clockwise, the driven gears 52 are driven to rotate the conveying rods 5, causing the sprockets 55 to move the chains 56 and to further move the material carrier 14 horizontally leftwards or rightwards toward the open space 15 in the left or right side (see FIGS. 18 and 19).

As indicated above, the invention has the following features and advantages:

1. The autonomous mobile robot 1 and the track 2 require less vertical installation space, and therefore the invention is suitable for use in a factory that has a limited vertical height.

2. The autonomous mobile robot 1 can send out the loaded material carrier 14 in horizontal to match with a conveyer 7 that is capable of conveying the material carrier 14 from the autonomous mobile robot 1 to a lifter 8, achieving an automatic operation.

3. The autonomous mobile robot 1 does not need any lifting mechanism on the inside. Therefore, the structure of the autonomous mobile robot 1 can be simplified, lowering the manufacturing cost and facilitating installation.

What is claimed is:

1. An autonomous mobile robot mounted on a track and controllable to move along said track and to stop at a selected location at said track, the autonomous mobile robot comprising:

a housing, a front cover covered on a front side of said housing, a rear cover covered on a rear side of said housing, front and rear friction transmission mechanisms respectively mounted on said housing at a top side and protected by a respective side guard, each said friction transmission mechanism comprising a plurality of friction wheels respectively kept in contact with a top surface of a bottom rail of said track, a robot driving motor mounted therein, a friction transmission mechanism driving wheel kept in contact with a bottom surface of said bottom rail of said track, a robot driving motor controllable to rotate said friction transmission mechanism driving wheel for causing the autonomous mobile robot to move along said track, wherein said housing comprises therein two upright supports respectively disposed near front and rear sides thereof, a plurality of conveying rods pivotally connected between said two upright supports in a parallel manner, a plurality of friction wheels respectively fixedly mounted on said conveying rods, a plurality of transmission gears respectively fixedly mounted on one end of each of said conveying rods, a plurality of driven gears respectively pivotally mounted on one said upright support and respectively meshed with said transmission gears, a driving gear meshed with two middle ones of said driven gears and affixed to a motor shaft of a carrier driving motor that is controllable to rotate said driving gear clockwise/counter-clockwise for enabling said driven gears to be driven to rotate said transmission gears and said conveying rods so that when a material carrier is placed on said friction wheels at said conveying rods, said friction wheels are rotatable with said conveying rods clockwise/counter-clockwise to move said material carrier horizontally leftwards/rightwards, two open spaces defining in two opposite lateral sides thereof, two side covers pivotally mounted on the two opposite lateral sides and adapted to close/open said open spaces, two side cover driving motors respectively mounted therein, two pinions respectively fixedly mounted on a respective output shaft of each of said side cover driving motors, two sector gears respectively fixedly mounted on said side covers and respectively meshed with said pinions such that when controlling said side cover driving motors to rotate clockwise/counter-clockwise, said sector gears are driven by said pinions to bias said side covers upwards/downwards and to further open/close said open spaces.

2. The autonomous mobile robot as claimed in claim 1, wherein said housing further comprises four coupling blocks disposed at a top side in four corners thereof, each said coupling block defining therein a coupling hole;

said side covers are respectively pivotally coupled between the coupling holes of said coupling blocks at the two opposite lateral sides of said housing.

* * * * *